US011905676B2

(12) United States Patent
Hrabarchuk et al.

(10) Patent No.: US 11,905,676 B2
(45) Date of Patent: Feb. 20, 2024

(54) EARTH MOVING IMPLEMENT WITH ADJUSTABLE CONFIGURATION EARTH MOVING BLADES

(71) Applicant: AG Shield Ltd., Benito (CA)

(72) Inventors: Michael G. Hrabarchuk, Benito (CA); Darin W. Hubscher, Benito (CA)

( * ) Notice: Subject to any disclaimer, the term of this patent is extended or adjusted under 35 U.S.C. 154(b) by 542 days.

(21) Appl. No.: 17/026,546

(22) Filed: Sep. 21, 2020

(65) Prior Publication Data

US 2021/0115645 A1 Apr. 22, 2021

Related U.S. Application Data

(60) Provisional application No. 62/916,369, filed on Oct. 17, 2019.

(51) Int. Cl.
*E02F 5/02* (2006.01)
*E02F 5/14* (2006.01)

(52) U.S. Cl.
CPC ..... *E02F 5/027* (2013.01); *E02F 5/14* (2013.01)

(58) Field of Classification Search
CPC ..... E02F 5/027; E02F 5/14; E02F 3/7681
See application file for complete search history.

(56) References Cited

U.S. PATENT DOCUMENTS 4,107 A * 7/1845 Stafford ..... E02F 5/027 37/366
321,355 A * 6/1885 Gifford ..... E02F 5/027 37/366
1,233,874 A * 7/1917 Hamilton ..... E02F 5/027 37/366
1,432,837 A * 10/1922 Campbell ..... E02F 5/027 37/366
1,502,591 A * 7/1924 Sargent ..... E01H 5/067 37/274
1,624,839 A * 4/1927 Lombard ..... E01H 5/067 37/270
1,822,964 A * 9/1931 Fredeen ..... E02F 9/06 405/73
2,136,911 A * 11/1938 Briscoe ..... E02F 5/027 37/372

(Continued)

FOREIGN PATENT DOCUMENTS

WO WO-2012151659 A1 * 11/2012 ..... A01B 13/02

*Primary Examiner* — Jamie L McGowan
(74) *Attorney, Agent, or Firm* — Ryan W. Dupuis; Kyle R. Satterthwaite; Ade & Company Inc.

(57) ABSTRACT

An earth moving implement for forming a ditch when towed across ground includes a frame, a tow arm connecting the frame to a towing vehicle, wheels supporting the frame for rolling movement along the ground, and a blade assembly comprising a plurality of earth moving blades. The blades include two main blades arranged to be configured to extend rearwardly in opposing lateral directions from a blade apex of the blade assembly such that the earth moving blades diverge rearwardly from the blade apex, and two outer blades supported on the main blades respectively. The orientation of the outer blades relative to the main blades and of the main blades relative to the frame can all be adjusted while the bottom cutting edges remain level with one another to readily vary cutting width and the lateral direction of earth movement by the blade assembly as desired.

19 Claims, 9 Drawing Sheets

(56) References Cited

U.S. PATENT DOCUMENTS 2,320,855 A * 6/1943 Dukes ..... E02F 5/027 37/372
2,453,723 A * 11/1948 Palmer ..... E02F 5/027 37/366
2,547,680 A * 4/1951 Wright ..... E02F 5/027 37/372
2,648,919 A * 8/1953 Brown ..... E02F 3/7627 37/372
2,668,376 A 2/1954 Briscoe
2,673,409 A * 3/1954 Briscoe ..... E02F 5/027 37/372
2,849,809 A * 9/1958 Chattin ..... E02F 3/7663 37/372
2,891,334 A * 6/1959 Kinzer ..... E02F 3/815 172/252
3,157,099 A * 11/1964 Ulrich ..... E02F 3/80 172/815
3,206,879 A * 9/1965 La Var ..... E02F 5/027 37/366
3,526,047 A 9/1970 Roessler
3,601,910 A * 8/1971 Goltz ..... E02F 3/7686 37/366
3,846,923 A * 11/1974 Whittier ..... E02F 5/027 37/366
4,099,578 A * 7/1978 Stevens ..... E02F 3/8155 172/815
4,223,461 A * 9/1980 Tackitt ..... E02F 3/815 172/815
4,552,226 A * 11/1985 Platter ..... E02F 3/7613 172/815
4,802,293 A * 2/1989 Smith ..... E02F 5/223 37/274
4,991,662 A * 2/1991 Caron ..... E02F 3/815 172/813
5,488,996 A * 2/1996 Barry ..... A01B 73/065 172/311
5,819,444 A * 10/1998 Desmarais ..... E01H 5/065 37/234
5,890,546 A * 4/1999 Kerpash, Sr. ..... E02F 3/7663 172/776
6,425,196 B1 * 7/2002 Weagley ..... E02F 3/815 37/270
7,469,648 B2 * 12/2008 Bettin ..... A01C 7/208 172/776
7,584,557 B1 * 9/2009 Nistler ..... E01H 5/065 37/234
8,291,624 B2 * 10/2012 Hall ..... E02F 3/844 37/444
8,418,777 B1 * 4/2013 Grossen ..... E02F 3/8155 172/799.5
9,371,627 B2 * 6/2016 Penner ..... E02F 3/8152
9,605,407 B2 * 3/2017 Penner ..... E02F 5/027
10,011,972 B2 * 7/2018 Helmeczi ..... E02F 3/8155
10,106,942 B2 * 10/2018 Roberge ..... E01H 5/061
10,132,050 B1 * 11/2018 Mandan ..... E02F 3/407
11,203,852 B2 * 12/2021 Vigneault ..... E02F 3/7631
2007/0163791 A1 * 7/2007 Meek ..... A01B 73/065 172/311
2014/0331527 A1 * 11/2014 Penner ..... E02F 3/8152 37/372
2017/0298583 A1 * 10/2017 Budrow ..... E01H 5/061
2021/0310212 A1 * 10/2021 Waldner ..... E02F 3/7677
2022/0074166 A1 * 3/2022 Garner ..... H02G 1/10
2022/0087215 A1 * 3/2022 Vorpahl ..... E02F 3/7627

* cited by examiner

EARTH MOVING IMPLEMENT WITH ADJUSTABLE CONFIGURATION EARTH MOVING BLADES

This application claims the benefit under 35 U.S.C. 119(e) of U.S. provisional application Ser. No. 62/916,369, filed Oct. 17, 2019.

FIELD OF THE INVENTION

The present invention relates to an implement used for moving earth and/or forming a ditch when towed across ground, and more particularly the present invention relates to an earth moving implement having earth moving blades adjustable between a plurality of different configurations which may include a V-shaped configuration diverging rearwardly from a central apex and/or a grader configuration in which the blades are substantially aligned with one another transversely to the forward direction of the implement.

BACKGROUND

In the agricultural industry, in many instances it is desirable to form ditches to allow drainage of precipitation which collects on agricultural fields. This is commonly accomplished by towing a ditching implement across the ground by connection to a towing vehicle such as an agricultural tractor. One known type of ditching implement includes a series of blades arranged in a V-shaped configuration diverging rearwardly from a forward apex to move earth laterally outwardly in two opposing directions from the forward apex as the implement is towed across the ground. The diverging blades assist in throwing material cut from the ground laterally outwardly as the implement is displaced forwardly across the ground.

Some examples of a ditching implement with blades in a V-shaped configuration include U.S. Pat. No. 2,668,376 by Briscoe, U.S. Pat. No. 2,673,409 also by Briscoe, and U.S. Pat. No. 3,526,047 by Roessler et al. In each instance a narrow V-shaped configuration of centre blades have cutting edges provided for cutting the bottom of a trench but the main blades extend laterally outward in opposing lateral directions at an upward inclination for further limiting the use of the implement to the cutting of deep and narrow trenches.

A further example of a ditching implement is disclosed in U.S. Pat. No. 9,605,407 by Penner. In this instance, blades are arranged in a V-shaped configuration to span a considerable horizontal width, however, when the blades are deployed in use, the blades are limited to a single orientation such that the implement is again limited in its use to a single application of wide, flat trenches.

In other instances, earth can be shaped and moved for forming ditches using a straight blade in a bulldozing configuration. Some straight blades are further provided with wings extending forwardly from opposing ends of the straight blade to assist in collection of material by the straight blade. U.S. Pat. No. 10,011,972 by Helmeczi discloses one example of the earth moving blade with forward projecting wings in which the orientation of the wings can be adjusted to vary the profile of the blade, however, the wings typically remain forwardly oriented relative to a straight blade section connected therebetween such that the earth moving blade is again limited to a single use of collecting and spreading material cut from the ground.

SUMMARY OF THE INVENTION

According to one aspect of the invention there is provided an earth moving implement for forming a ditch when towed across ground in a forward working direction by a towing vehicle, the earth moving implement comprising:

a main frame defining a longitudinal axis extending in the forward working direction from a rear end to a front end of the frame;

a tow arm connected to the frame and arranged for connection to the towing vehicle;

two wheels rotatably supported on the main frame so as to be arranged to support the frame for rolling movement along the ground, the two wheels being spaced apart in opposing lateral directions from the longitudinal axis of the main frame along a lateral axis oriented perpendicularly to the longitudinal axis;

a blade assembly supported on the main frame comprising a plurality of earth moving blades arranged to be configured to extend rearwardly in said opposing lateral directions from a blade apex of the blade assembly such that the earth moving blades diverge rearwardly from the blade apex;

the earth moving blades including two main blades supported on the main frame, each main blade extending in a respective one of the opposing lateral directions from an inner end of the main blade pivotally coupled in proximity to the blade apex of the blade assembly to an outer end of the main blade such that the main blade is pivotal relative to the main frame about a respective upright axis; and the earth moving blades including two outer blades operatively connected to the two main blades respectively, each outer blade extending outwardly from an inner end of the outer blade pivotal coupled in proximity to the outer end of the respective main blade to an outer end of the outer blade such that the outer blade is pivotal relative to the respective main blade about a respective upright axis;

each of the main blades and the outer blades having a bottom cutting edge arranged for cutting into the ground;

whereby pivotal movement of the outer blades relative to the main blades and pivotal movement of the main blades relative to the main frame acts to vary an overall cutting width of the bottom cutting edges of the earth moving blades in a direction of the lateral axis.

By providing each of the main blades and the outer blades at opposing sides of the apex of the blade assembly together with all of the blades being pivotal about respective upright axes, the bottom cutting edges of the blades remain oriented for cutting into the ground through a wide range of blade orientations and configurations so that the implement is highly adaptable to form various widths of ditches while also being highly adaptable to a variety of different ground conditions by varying the draft forces required to pull the implement.

When the bottom cutting edges of the blades remain in a common plane with one another throughout pivoting adjustment of the main blades relative to the lead blades and pivoting adjustment of the outer blades relative to the main blades, the overall configuration of blades can vary between a V-shaped configuration for throwing dirt while forming a ditch and a box blade configuration for collecting dirt while forming a ditch in a manner unseen in prior art earth moving implements.

The outer blades can be pivoted relative to the respective main blades independently of one another to further enable configurations where material cut from the ground is thrown laterally outwardly from one side of the implement while being collected by the outer blade at the other side of the implement if desired.

In some instances, the two wheels of the main frame can be adjustable in height relative to the main frame independently of one another while all of the blades on the main frame have bottom cutting edges lying in a common plane such that the common cutting plane of the blades collectively can be adjusted in angular orientation about the longitudinal axis of the implement relative to the ground. This is particularly suited for shaping the slopes at opposing sides of very large ditches being formed.

In the illustrated embodiment, the earth moving blades of the blade assembly further comprise two lead blades supported in fixed relation on the main frame so as to meet one another at the blade apex of the blade assembly and so as to extend rearwardly in said opposing lateral directions from the blade apex.

Preferably the bottom cutting edges of the main blades occupy a majority of the overall cutting width of the earth moving blades.

Preferably the cutting edges of the main blades lie in a common plane with one another as the main blades are pivoted about the respective upright axes relative to the main frame.

Preferably the cutting edges of the outer blades lie in a common plane with the bottom cutting edges of the main blades as the outer blades are pivoted about the respective upright axes relative to the main blades.

Preferably the main blades are pivotal from a forward position oriented nearer to the lateral axis than the longitudinal axis to a rear position oriented nearer to the longitudinal axis than the lateral axis. For example, the main blades may be oriented at less than 10 degrees from the lateral axis in the forward position. One or both of the main blades may also be pivotal beyond the forward position to a forwardmost position in which the main blade extends laterally outwardly at a forward slope.

Preferably the outer blades are pivotal relative to the main blades so as to be positionable at an angle of less than 45 degrees from the from the longitudinal axis when the main blades are in the forward position. The main blades may be oriented at less than 45 degrees from the longitudinal axis in the rear position. More particularly, the outer blades may be pivotal relative to the main blades so as to be positionable at an angle of less than 10 degrees from the lateral axis when the main blades are oriented at a prescribed angle from the longitudinal axis that is between 25 and 45 degrees.

In the illustrated embodiment, a brace arm connects each main blade to the main frame such that the brace arms extend rearwardly and inwardly towards one another. In this instance, each brace arm is preferably oriented at an angle from the longitudinal axis of less than 45 degrees throughout an overall range of pivotal movement of the main blades relative to the main frame. When the main blades are pivotal into a forward position oriented at less than 10 degrees from the lateral axis, the brace arms are preferably oriented at less than 45 degrees from the longitudinal axis in the forward position. The implement may further include a carriage member slidably mounted on the main frame along the longitudinal axis of the main frame, in which the brace members are pivotally coupled to the main blades respectively at respective outer ends of the brace members, and the brace members are pivotally coupled at laterally spaced apart positions at laterally opposing sides of the carriage member at respective inner ends of the brace members. The carriage member is preferably arranged to be fixed relative to the main frame by a locking member at any selected one of a plurality of designated mounting locations between a forward position and a rear position of the main blades relative to the main frame.

When the bottom cutting edges of the main blades lie in a common plane with one another, the two wheels may be adjustable in height relative to the main frame independently from one another so as to be arranged to vary an angular orientation of said common plane of the bottom cutting edges of the main blades together with the main frame relative to the ground about the longitudinal axis. In this instance, the implement may further include two trailing arms pivotally coupled to the main frame are respective front ends of the trailing arms and respectively supporting the two wheels rotatably thereon at respective rear ends of the trailing arms in which the trailing arms are independently pivotal relative to the main frame so as to vary the heights of the respective wheels relative to the main frame.

Each outer blade may be pivotal relative to the respective main blade between a first position in which the outer blade extends outward from the outer end of the main blade at an angle of less than 5 degrees from the main blade, and a second position in which the inner end of the outer blade abuts a front face of the main blade at a location spaced inwardly from the outer end of the main blade and is oriented at an angle greater than 45 degrees from the main blade. When the front face of each main blade is concave from the bottom cutting edge to an opposing top edge, an inner edge at the inner end of each outer blade may be convex in shape so as to mate with the concave front face of the respective main blade in the second position of the outer blade.

According to a second aspect of the present invention there is provided an earth moving implement for forming a ditch when towed across ground in a forward working direction by a towing vehicle, the earth moving implement comprising:

a main frame defining a longitudinal axis extending in the forward working direction from a rear end to a front end of the frame;

a tow arm connected to the frame and arranged for connection to the towing vehicle;

two wheels rotatably supported on the main frame so as to be arranged to support the frame for rolling movement along the ground, the two wheels being spaced apart in opposing lateral directions from the longitudinal axis of the main frame along a lateral axis oriented perpendicularly to the longitudinal axis;

a blade assembly supported on the main frame comprising a plurality of earth moving blades arranged to be configured to extend rearwardly in said opposing lateral directions from a blade apex of the blade assembly such that the earth moving blades diverge rearwardly from the blade apex;

the earth moving blades including two main blades supported on the main frame, each main blade extending in a respective one of the opposing lateral directions from an inner end of the main blade pivotally coupled in proximity to the blade apex of the blade assembly to an outer end of the main blade such that the main blade is pivotal relative to the main frame about a respective upright axis; and the earth moving blades including two outer blades operatively connected to the two main blades respectively, each outer blade extending outwardly from an inner end of the outer blade pivotal coupled in proximity to the outer end of the respective main blade to an outer end of the outer blade such that the outer blade is pivotal relative to the respective main blade about a respective upright axis;

each of the main blades and the outer blades having a bottom cutting edge arranged for cutting into the ground;

the bottom cutting edges of the outer blades lying in a common plane with one another as the outer blades are pivoted about the respective upright axes relative to the main blades; and the outer blades being pivotal relative to the main blades independently of one another.

According to a third aspect of the present invention there is provided an earth moving implement for forming a ditch when towed across ground in a forward working direction by a towing vehicle, the earth moving implement comprising:

a main frame defining a longitudinal axis extending in the forward working direction from a rear end to a front end of the frame;

a tow arm connected to the frame and arranged for connection to the towing vehicle;

two wheels rotatably supported on the main frame so as to be arranged to support the frame for rolling movement along the ground, the two wheels being spaced apart in opposing lateral directions from the longitudinal axis of the main frame along a lateral axis oriented perpendicularly to the longitudinal axis;

a blade assembly supported on the main frame comprising a plurality of earth moving blades arranged to be configured to extend rearwardly in said opposing lateral directions from a blade apex of the blade assembly such that the earth moving blades diverge rearwardly from the blade apex;

the earth moving blades including two main blades supported on the main frame, each main blade extending in a respective one of the opposing lateral directions from an inner end of the main blade pivotally coupled in proximity to the blade apex of the blade assembly to an outer end of the main blade;

each of the main blades having a bottom cutting edge arranged for cutting into the ground;

the bottom cutting edges of the main blades lying in a common plane with one another; and the two wheels being adjustable in height relative to the main frame independently from one another so as to be arranged to vary an angular orientation of said common plane of the bottom cutting edges of the main blades together with the main frame relative to the ground about the longitudinal axis.

In this instance, the implement may further include two trailing arms pivotally coupled to the main frame are respective front ends of the trailing arms and respectively supporting the two wheels rotatably thereon at respective rear ends of the trailing arms, the trailing arms being independently pivotal relative to the main frame so as to vary the heights of the respective wheels relative to the main frame.

According to another aspect of the invention there is provided an earth moving implement for forming a ditch when towed across ground in a forward working direction by a towing vehicle, the earth moving implement comprising:

a main frame defining a longitudinal axis extending in the forward working direction from a rear end to a front end of the frame;

a tow arm connected to the frame and arranged for connection to the towing vehicle;

two wheels rotatably supported on the main frame so as to be arranged to support the frame for rolling movement along the ground, the two wheels being spaced apart in opposing lateral directions from the longitudinal axis of the main frame along a lateral axis oriented perpendicularly to the longitudinal axis;

two lead blades supported in fixed relation on the main frame and extending rearwardly in said opposing lateral directions from a blade apex at the longitudinal axis such that the lead blades diverge rearwardly from one another towards respective rear edges of the lead blades;

two main blades supported on the main frame, each main blade extending in a respective one of the opposing lateral directions from an inner end of the main blade pivotally coupled in proximity to the rear edge of a respective one of the lead blades to an outer end of the main blade such that the main blade is pivotal relative to the respective lead blade about a respective upright axis; and two outer blades operatively connected to the two main blades respectively, each outer blade extending outwardly from an inner end of the outer blade pivotal coupled in proximity to the outer end of the respective main blade to an outer end of the outer blade such that the outer blade is pivotal relative to the respective main blade about a respective upright axis;

each of the lead blades, the main blades and the outer blades having a bottom cutting edge arranged for cutting into the ground;

whereby pivotal movement of the outer blades relative to the main blades and pivotal movement of the main blades relative to the lead blades acts to vary an overall cutting width of the bottom cutting edges of the blades in a direction of the lateral axis.

BRIEF DESCRIPTION OF THE DRAWINGS

One embodiment of the invention will now be described in conjunction with the accompanying drawings in which.

In the drawings like characters of reference indicate corresponding parts in the different figures.

DETAILED DESCRIPTION

Figure 1:
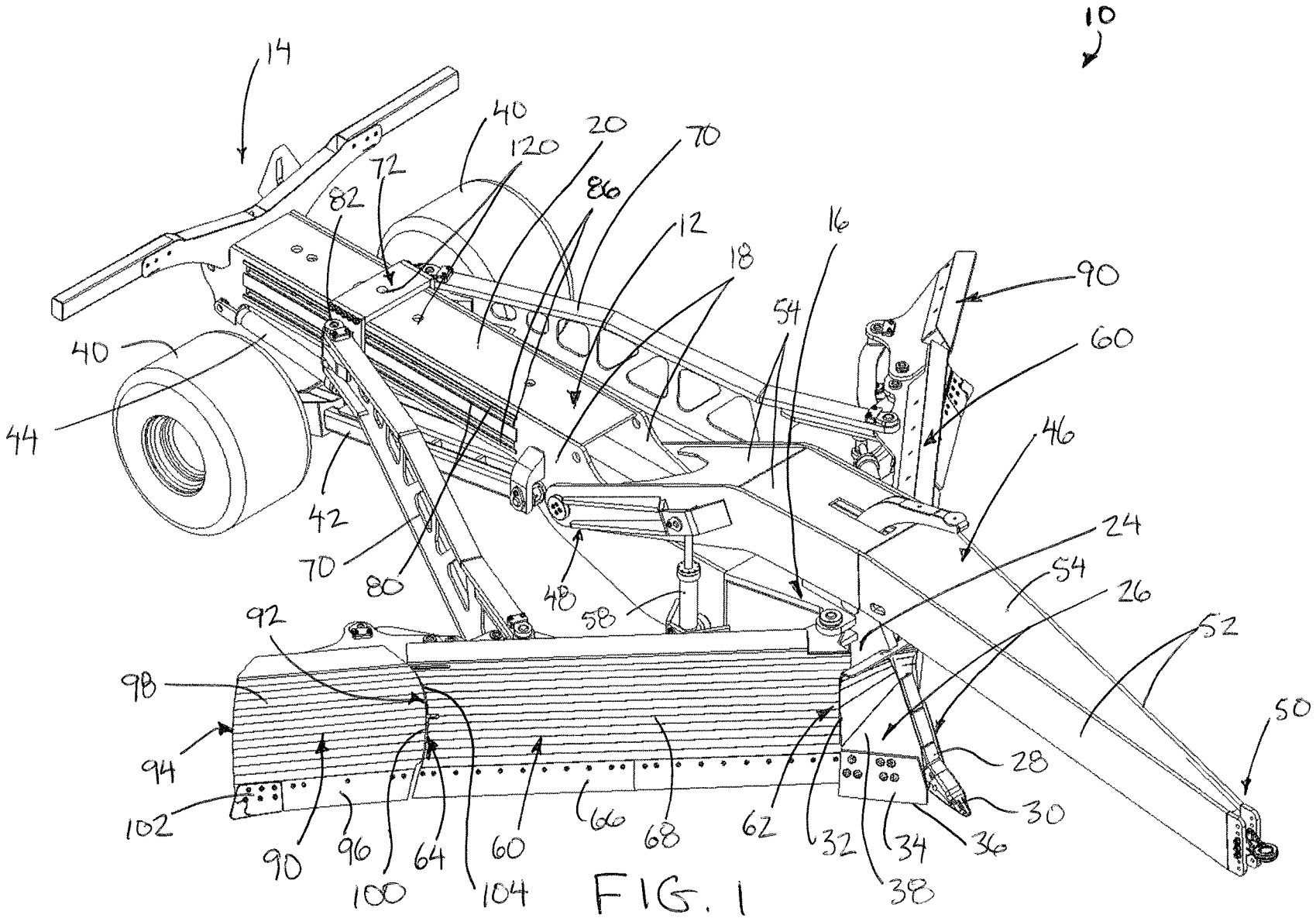
FIG. 1 is a perspective view of the earth moving implement in a normal mode of operation for forming medium width trenches.
Figure 2:
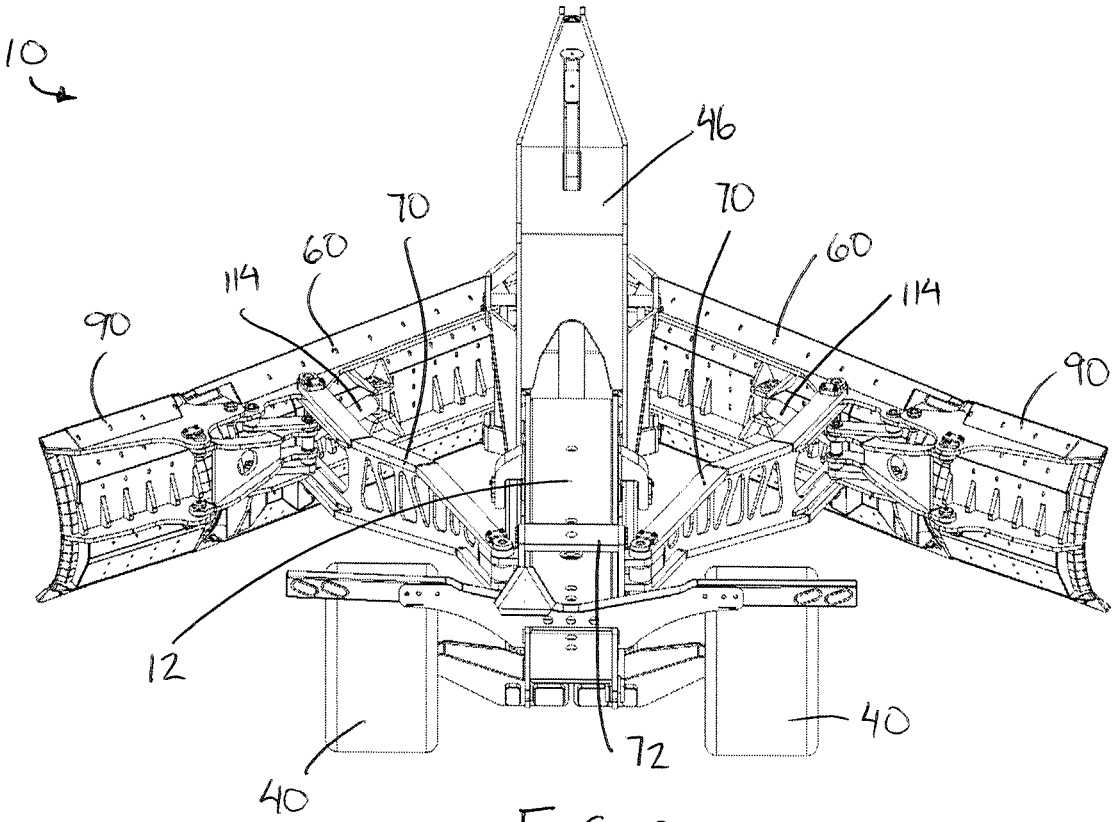
FIG. 2 is a perspective view of a rear of the earth moving implement according to FIG. 1.

Referring to the accompanying figures there is illustrated an earth moving implement generally indicated by reference numeral 10. The implement 10 is particularly suited for connection to a towing vehicle, for example a tractor, to follow the vehicle across the ground in a forward working direction of the tractor and the implement.

The implement generally includes a main frame 12 extending in the direction of a longitudinal axis of the frame which is oriented in the forward working direction to extend from a rear end 14 of the main frame to a front end 16 of the main frame. The main frame 12 is primarily formed by two side plates 18 which are parallel and spaced apart from one another at laterally opposing sides of the frame. The side plates are joined to one another at respective top edges by one or more top plates 20 extending between the side plates at the top side of the frame and one or more bottom plates 22 extending between the bottom edges of the side plates at the bottom of the frame. Collectively the side plates, and the top and bottom plates, form a rigid box beam extending in the direction of the longitudinal axis of the frame. The main frame 12 further includes a front plate 24 mounted at the front end of the beam formed by the side plates of the frame. The front plate 24 is vertically oriented to protrude forwardly in the direction of the longitudinal axis from the beam while being centred in a lateral direction between the laterally opposing sides of the beam.

The implement includes a blade assembly comprising a plurality of earth moving blades described in further detail below which can be arranged in multiple configurations relative to one another. The multiple blade configurations include a V shaped configuration in which the earth moving blades of the blade assembly diverge rearwardly and laterally outwardly from opposing sides of a laterally central apex 28 of the blade assembly.

In the illustrated embodiment, the earth moving blades of the blade assembly includes two lead blades 26 which are fixed onto the front end of the frame 12 in the V shaped configuration relative to one another so that the two lead blades 26 are supported on opposing sides of the front plate 24, corresponding to opposing sides of the longitudinal axis of the frame when the longitudinal axis passes through the apex formed by the lead blades. The inner edges of the lead blades are supported in abutment against opposing sides of the front plate 24 of the frame such that the leading edge of the front plate 24 defines the central apex 28 of the blades in this instance. The leading edge of the front plate 24 is sloped upwardly and rearwards from a bottom leading edge thereof while being laterally centred relative to the longitudinal axis.

A ground opener 30 may be replaceably mounted at the bottom end of the front plate 24 to protrude at a downward and forward slope to a pointed apex of the opener 30. In this instance, an implement shank can be supported at the bottom of the leading edge of the front plate 24 for insertion into the socket at the rear of a replaceable tip body forming the opener. A transverse pin can be inserted through transverse apertures in the tip body and the shank to replaceably secure the opener on the frame of the implement.

The two lead blades 26 extend rearward from the apex 28 in opposing lateral directions away from the apex towards respective rear edges 32 of the lead blades at the outer ends of the lead blades. Each lead blade includes a lower plate 34 comprising a flat rigid rectangular strip of material defining a bottom cutting edge 36 at the bottom of the lead blade, while extending at an upward and rearward slope from the bottom cutting edge. The bottom cutting edges of the two lead blades lie in a common cutting plane relative to one another with the apex of the ground opener 30 further lying approximately in the common cutting plane together with the bottom cutting edges of the lead blades.

Each lead blade further includes an upper plate 38 spanning a majority of a height of the blade which extends upwardly from the lower plate 34 to an opposing top edge of the lead blade. A forward face of each lead blade defined primarily by the upper plate 38 is generally concave between the bottom cutting edge defined by the lower plate and the opposing top edge of the upper plate.

Each lead blade extends at a rearward slope from the inner edges adjacent to the front plate 24 to respective outer edges at a rearward slope which may be near 45° from the longitudinal axis for example.

The rear end of the main frame 12 opposite the lead blades 26, are supported by two transport wheels 40. The two wheels 40 are spaced apart in a lateral direction of a lateral axis that is oriented perpendicularly to the longitudinal axis such that the two wheels 40 are positioned approximately at laterally opposing sides of the main frame 12. The wheels are supported for rolling movement about respective wheel axes which are parallel to the lateral axis. The wheels are further spaced apart from one another in the direction of the lateral axis.

Each wheel 40 is carried on a respective trailing arm 42 which is pivotally coupled to the main frame at a front end of the trailing arm such that the trailing arm extends downwardly and rearwardly to a respective rear end supporting the respective wheel 40 thereon. The forward ends of the trailing arms 40 are pivotally coupled to the main frame at laterally spaced apart locations at an intermediate location in the longitudinal direction of the main frame which is in close proximity to a longitudinal centre of the main frame between the forward and rearward ends thereof. Each trailing arm extends rearwardly at a downward slope at a low angle from horizontal, for example at less than 45° from the longitudinal axis when the longitudinal axis is approximately horizontal. The length of the trailing arms is arranged such that the wheels 40 supported on the rear ends of the trailing arms are positioned in close proximity but spaced below the rear end of the main frame 12 of the implement.

The wheels supported on the rear ends of the trailing arms typically remain spaced slightly forwardly of the rear end of the frame throughout the pivoting range of movement of the trailing arms relative to the main frame. Pivoting of each trailing arm relative to the main frame has the effect of raising and lowering the height or elevation of the respective wheel 40 of that trailing arm relative to the main frame 12. The height is controlled by a wheel actuator 44 associated with each trailing arm.

Each wheel actuator 44 is a linear hydraulic actuator extending from a first end pivotally coupled at the rear end of the main frame at a downward and forward slope to a respective second end which is pivotally coupled at the rear end of a respective one of the trailing arms. Extension and retraction of each wheel actuator causes the corresponding trailing arm and the wheel supported at the rear end thereof to vary in elevation relative to the main frame 12. By varying the elevation of the rear wheels relative to the main frame independently of one another such that the height of one wheel will be varied relative to the height of the other wheel, the angular orientation of the main frame about the longitudinal axis relative to the ground will be varied. As the lead blades are fixed relative to the main frame, varying the angular orientation of the main frame relative to the ground will also vary the angular orientation of the common cutting plane of the blades about the longitudinal axis relative to the ground.

The implement further includes a hitch arm 46 which is pivotally coupled at a rear end of the hitch arm on the frame 12 at an intermediate location in the longitudinal direction thereof to extend forwardly from the rear end 48 of the hitch arm to a front end 50 of the hitch arm which is spaced forwardly from the lead blades at the front end of the main frame 12. A suitable hitch connector is provided at the front end 50 of the hitch arm which is arranged for connection to the towing vehicle.

The hitch arm is primarily formed of two side plates 52 which are rigid and parallel to one another at laterally opposing sides of the hitch arm to extend longitudinally from the rear end 48 to the front end 50 of the hitch arm. The side plates 52 are joined by one or more top plates 54 extending between top edges of the side plates at the top of the hitch arm and one or more bottom plates 56 connected between bottom edges of the side plates at the bottom of the hitch arm such that the plates collectively form a rigid box beam extending longitudinally between the front and rear ends of the hitch arm. The overall shape of the beam is curved in the longitudinal direction such that a bottom of the beam forming the hitch arm is generally concave between the front and rear ends of the hitch arm and such that the hitch arm is suitable for extending up and over the lead blades 26 at the front end of the main frame 12.

The side plates 52 extend rearwardly beyond the top and bottom plates at the rear end of the hitch arm to define parallel and spaced apart mounting portions arranged for extending over laterally opposing sides of the main frame at the pivotal connection of the rear end 48 of the hitch arm onto the main frame. The rear ends of the side plates 52 are pivotally coupled onto the main frame at a location which is near a centre of the main frame in the longitudinal direction so as to be in close proximity to but spaced slightly forwardly of the location of the pivotal connection of the trailing arms of the rear wheels 40. A rearward portion of the hitch arm extends forwardly at an upward slope to extend over the lead blades while the forward portion of the hitch arm ahead of the lead blades extends forwardly at a downward slope to the hitch connector at the forward end thereof at a location which is spaced forwardly of the lead blades.

The front end of the main frame 12 is typically suspended below the hitch arm 46 by a pair of lift actuators 58 are coupled between the main frame at the bottom ends of the actuators and the hitch arm at the top ends of the actuators. The two lift actuators 48 are provided at laterally opposing sides of the main frame and hitch arm respectively so as to be pivotally coupled to the main frame in proximity to the front end thereof while being pivotally coupled to the hitch arm at a corresponding location directly above the pivotal connection to the main frame so that each lift actuator is generally upright and near vertical in orientation. The lift actuators remain spaced rearwardly of the lead blades.

The lift actuators 58 are hydraulic linear actuators which are typically operated together in unison so that when the actuators are extended, the elevation of the front end of the main frame and the lead blades supported thereon will be lowered relative to the hitch arm for more aggressive engagement of the blades into the ground. Alternatively, when the lift actuators are retracted in unison, the elevation of the front end of the main frame and the lead blades supported thereon will be raised relative to the hitch arm to provide a less aggressive engagement of the blades into the ground during operation. Fully elevating the blades relative to the hitch arm can also assist in disengaging the blades from the ground entirely when it is desired to transport the implement on roadways for example.

The extension and retraction of the lift actuators effectively causes the angular orientation of the main frame about a lateral axis relative to the ground to be adjusted which in turn adjusts the angular orientation of the common cutting plane of the blades relative to the ground about the lateral axis.

The earth moving blades of the blade assembly of the implement further include two main blades 60 also carried on the main frame 12 to extend laterally outwardly from opposing sides of the central apex 28 of the blade assembly. The main blades are supported at laterally opposing sides of the main frame in trailing relationship with respective ones of the two lead blades 26. More particularly, each main blade 60 extends laterally outwardly from the main frame from (i) an inner end 62 pivotally coupled onto the main frame rearward in proximity to the central apex 28 of the blade assembly or in trailing relationship of the outer edge of a respective one of the lead blades 26, to (ii) a corresponding rear or outer end 64 of the main blade.

The inner end 62 of each main blade is pivotally coupled to the main frame for pivotal movement about a respective upright main axis which is perpendicular to the common cutting plane of the blades. Pivoting of each main blade relative to the main frame causes the angular orientation of the main blade about the respective upright axis to be varied relative to the main frame. The main blades 60 can be pivoted through a large range of angles relative to the main frame from a forward position in which the main blades are oriented generally in the lateral direction so as to be near perpendicular to the longitudinal axis and the forward working direction, to a rearward position in which the main blades are oriented to be nearer in orientation to the longitudinal axis than the lateral axis.

Figure 9:
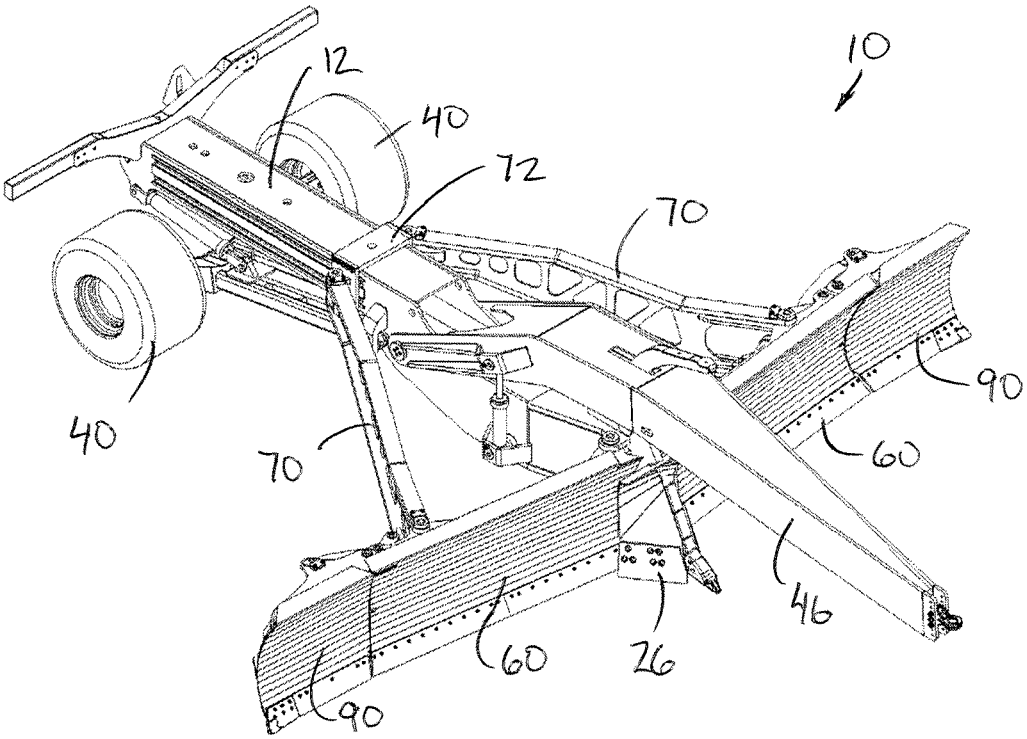
FIG. 9 is a perspective view of the earth moving implement in a grader mode for leveling and shaping ground.

In some embodiments, one or both main blades can be independently pivoted beyond the forward position shown in FIG. 9 to a forwardmost position in which the main blade extends laterally outwardly at a forward slope so as to be oriented at an inclination of 20 to 25 degrees forwardly of the lateral axis.

Each main blade includes a lower plate 66 extending along a full length of the main blade at the bottom side thereof so as to define a bottom cutting edge of the blade. The lower plate is a flat rigid plate extending upward at a slight rearward slope. The main blade further includes an upper plate 68 spanning the full length of the main blade above the lower plate and which defines a majority of the front face of the main blade. The front face of the main blade is generally concave from the bottom cutting edge defined by the lower plate to a top edge of the blade defined by the upper plate 68.

Similarly to the lead blades, the lower plate 66 is secured to the upper plate 68 using threaded fasteners and the like so that the lower plates 66 can be removed and replaced as desired when they become worn. The pivotal connections that support the main blades relative to the main frame are only coupled to the upper plate 68 forming the upper portion of the main blades so that the lower plates are only secured relative to the main frame by connection to the upper plates respectively.

To support the main blades through pivotal movement relative to the main frame, two braces 70 are provided which are coupled between the main blades 60 and the main frame respectively at laterally opposing sides of the main frame. Each brace 70 is a rigid frame member pivotally coupled at an outer end of the brace to the respective main blade at the rear side of the main blade at an intermediate location in the longitudinal direction of the blade which is closer to the outer end of the blade than the inner end thereof. The brace 70 is pivotal relative to the respective main blade about an upright axis which is parallel to the main pivot axis of the blade relative to the main frame so as to also be perpendicular to the common cutting plane of the blades.

The inner end of each brace 70 is pivotally coupled to a common carriage member 72 which is mounted onto the main frame for longitudinal sliding movement in the direction of the longitudinal axis relative to the main frame.

The carriage member 72 comprises two side plates 74 which are parallel to one another and spaced apart from one another so as to be positioned adjacent to the exterior sides of the side plates forming the opposing sides of the main rigid beam of the main frame 12. A top plate 76 and a bottom plate 78 are connected between the respective top edges and bottom edges of the side plates 74 to extend over and under the main frame respectively so that the carriage member extends about the full circumference of the main frame while being supported for longitudinal sliding relative to the main frame. One or more wear resistant sheets 80, for example plates formed of a material having a high hardness such as stainless steel, can be mounted along exterior surfaces of the main frame which are overlapped by the corresponding plates of the carriage member as the carriage member is longitudinally displaced relative to the main frame to assist in supporting the carriage member for sliding movement along the main frame.

A pivot shaft 82 is supported on each of the side plates 74 of the carriage member such that the pivot shafts are provided at laterally opposing sides of the main frame to be suitably oriented for pivotally coupling the inner ends of the two braces 70 respectively thereon. The inner ends of the braces are thus pivotally coupled on the carriage member at laterally spaced apart locations about respective upright pivot axes which are parallel to the pivot axis at the outer ends of the braces so that the pivot axes at the inner ends are also perpendicular to the common cutting plane of the lead blades.

The carriage member further includes two intermediate plates 84 which are connected between the side plates 74 at intermediate locations spaced between the top and bottom plates by extending through corresponding longitudinal slots 86 formed in the side plates at opposing sides of the main frame. A fold actuator 88 is supported within the hollow interior of the main frame to extend in the direction of the longitudinal axis of the main frame between a first end coupled to the main frame at the front end of the main frame and a second end connected to the intermediate plates 84 of the carriage member. The fold actuator is a hydraulic linear actuator which can be extended and retracted to displace the carriage member longitudinally along the main frame between opposing ends of the slots 86.

When they fold actuator 88 is extended, the carriage member is displaced towards the rear ends of the slots 86 so that the main blades are closer in orientation to the longitudinal axis than the lateral axis which defines the narrowest width of the blades in a direction perpendicular to the forward working direction. The braces 70 in this instance are also nearer in orientation to the longitudinal axis so as to be oriented at an angle of less than 20° from the longitudinal axis in the illustrated example.

When the fold actuator 88 is retracted, the carriage member is displaced towards the forward ends of the slots 86 so that the main blades are closer in orientation to the lateral axis than the longitudinal axis and so that the blades define the greatest cutting width in the direction perpendicular to the forward working direction. The braces 70 in this instance remain oriented to be nearer in orientation to the longitudinal axis than the lateral axis, but are displaced to a greater angle from the longitudinal axis than when the fold actuator is extended.

The main blades can be modified to extend forwardly beyond the forward position shown in FIG. 9 to a forwardmost position in which the main blades extend laterally outwardly at a forward slope of 20 to 25 degrees ahead of the lateral axis, by extending the slots 86 forwardly beyond the length of the slots shown in the illustrated embodiment. In yet further arrangements, the pivotal connection of the respective brace 70 to either of the main blade or the carriage member may be further adjustable to allow one main blade to be oriented independently of the other main blade.

The earth moving blades of the blade assembly of the implement further include two outer blades 90 which are pivotally mounted onto the outer ends of the main blades respectively. The outer blades are entirely supported on the main blades so as to be movable relative to the main frame together with the main blades. The outer blades 90 each extend longitudinally from the respective inner end 92 to a respective outer end 94. The outer blades 90 extend longitudinally of the blades a distance which is much shorter than the corresponding main blades. The lead blades similarly extend between the inner edges and the outer edges thereof a distance which is much shorter than the main blades such that the main blades define a majority of an overall cutting width of the blades in the lateral direction throughout pivoting movement of the blades between the various configurations thereof.

Each outer blade similarly includes a lower plate 96 defining a lower portion of the blade which extends longitudinally the full length of the blade to define the bottom cutting edge of the blade at the bottom of the blade. The lower plate is generally a rigid flat plate that extends at an upward and rearward slope from the bottom cutting edge thereof. The outer blade is positioned such that the bottom cutting edge lies in the common cutting plane of the lead and main blades even as the outer blade is pivoted in orientation relative to the respective main blade as described in further detail below.

Each outer blade also includes an upper plate 98 extending upward from the lower plate to occupy the majority of the outer blade across the full length of the blade from the inner end to the outer end thereof. The upper plate 98 defines a majority of the front face of the outer blade which is generally concave in shape from the bottom cutting edge of the lower plate to an opposing top edge of the outer blade defined by the upper plate.

All connections supporting the outer blade relative to the respective main blade are connected to the upper plate so that the lower plate is entirely supported on the implement by connection to the upper plate through releasable fasteners permitting the lower plate to be replaced as it becomes worn similarly to the lower plates of the other blades.

The upright inner edge 100 at the inner and of each outer blade is generally curved so as to be convex in shape along the height thereof to approximately match the profile of the concave face of the corresponding main blade, thus enabling the outer blade to be abutted transversely with the front face of the corresponding main blade in some orientations of the outer blade as described further below.

Each outer blade also includes a cutting tip 102 mounted at the outer end of the lower plate 96 to define the outermost end portion of the bottom cutting edge of the blade. The cutting tip is formed of a hardened material relative to the remainder of the blade similarly to the other lower plates 96 of the blades. The cutting tip 102 differs from the other lower plates by having a further hardened material tip at the outermost bottom corner which protrudes slightly below the common cutting plane of the blades by forming a pointed apex having an interior angle of less than 90° for aggressively cutting into the soil at the outermost ends of the blades.

The inner end of each outer blade 90 forms a pivotal connection to the respective main blade at the outer end thereof adjacent the rear of the blade so as to be pivotal about an upright outer axis of the outer blade which is parallel to the pivot axes of the main blades relative to the main frame, so as to be similarly perpendicular to the common cutting plane of the blades as previously stated with regard to the pivot axes of the main blades 60. In this manner each outer blade is pivotal from a first position corresponding to an undeployed position of the outer blade to a second position corresponding to a deployed position of the outer blade in which the convex inner edge of the outer blade mates with the concave front face of the main blade as noted above.

In the first position, for example as shown in FIG. 1, the outer blade is substantially aligned with the corresponding main blade so that the bottom cutting edge of the outer blade is continuous with and in close alignment with the main blade by having less than 5° of angular separation therebetween for example. In this position, the convex inner edge 100 of the outer blade meets with a corresponding outer edge 104 of the respective main blade which is instead formed to be concave between the top and bottom edges of the blade.

Figure 10:
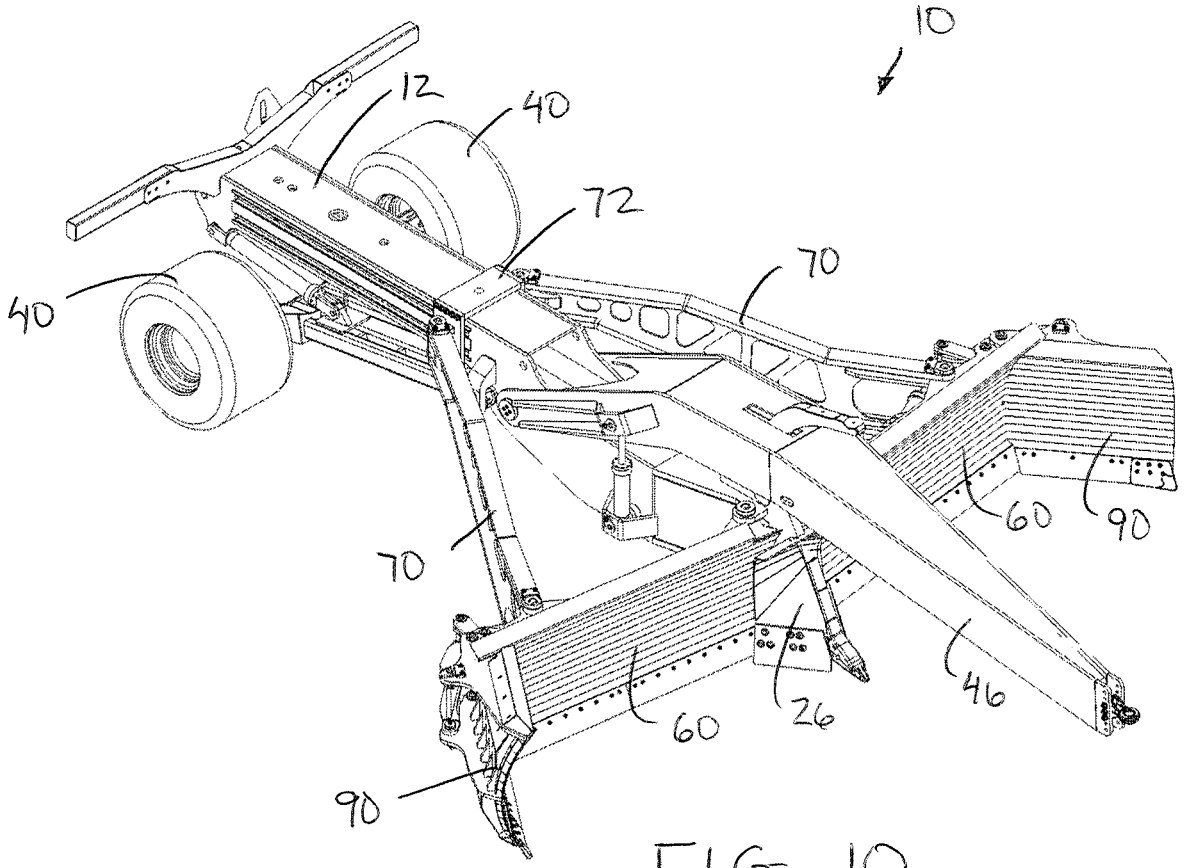
FIG. 10 is a perspective view of the earth moving implement in a carrying mode for carrying and spreading material on the ground.
Figure 11:
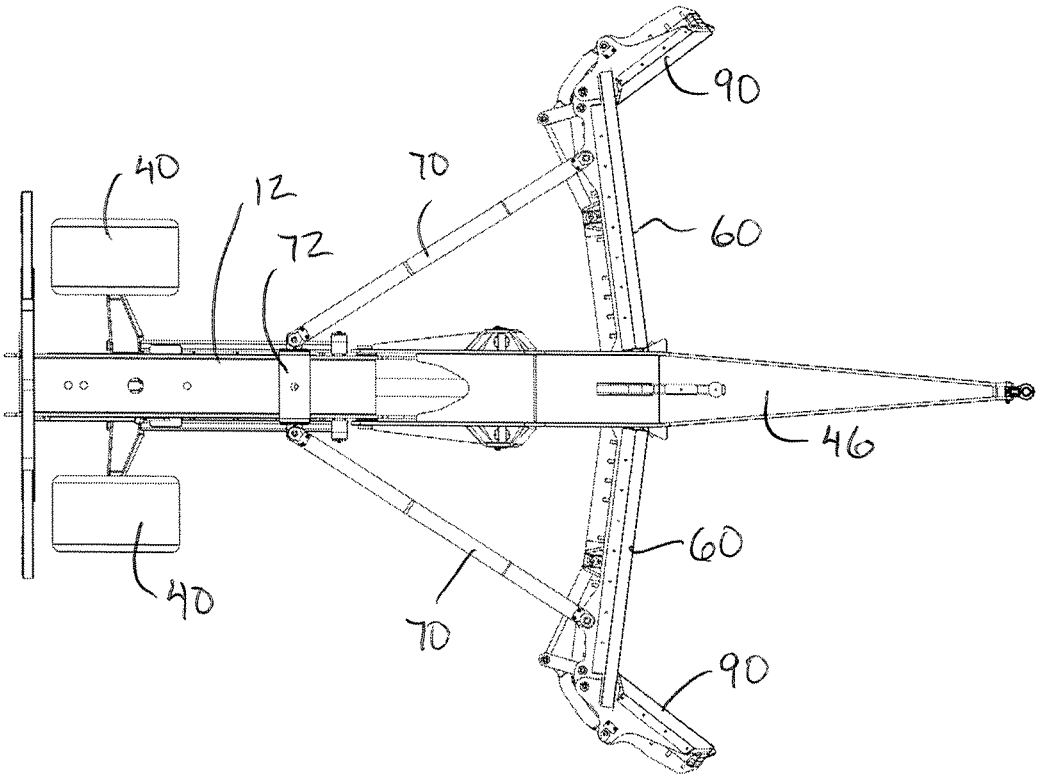
FIG. 11 is a top plan view of the earth moving implement in the carrying mode.

In the second position, for example as shown in FIG. 10, the outer blades are oriented transversely to the respective main blades such that an obtuse interior angle between the front faces of the outer blade and main blade may be between 90° and 135° for example. In this instance, the convex inner edge 100 of the outer blade is abutted with the concave profile of the front face of the main blade at a location which is spaced slightly inwardly from the outer edge 104 of the main blade.

The two outer blades 90 can be operated between the first and second positions thereof independently of one another such that only one of the outer blades may be deployed while the other remains undeployed in some instances. Positioning of the outer blades is accomplished by a pair of linkages associated with the pair of outer blades respectively.

Each of the linkages for moving the respective outer blade between the first and second positions thereof is fully carried on the respective main blade with which the outer blade is coupled. The linkage comprises first arms 106 fixed at the rear of the outer blade to extend inwardly beyond the inner end of the outer blade for overlapping the rear of the main blade at the outer end thereof to form the pivotal connection that defines the upright pivot axis of the outer blade relative to the main blade located rearwardly of the outer end of the main blade. A pair of second arms 108 extend rearward from the outer blade at a location spaced outward from the first arms to form a pivotal connection to other components of the linkage as noted below.

Each linkage further includes first links 110 which are pivotally coupled at respective first ends at a location rearward of the outer ends of the main blade close to the location of the outer pivot axis of the outer blade. The first links extend radially outward and generally rearward of the main blade to respective second ends forming a pivotal connection to a pair of second links 112. The second links are pivotally coupled at respective first ends to the second ends of the first links 110 and extend outwardly beyond the outer ends of the main blades for pivotal connection at respective second ends to the trailing rear ends of the second arms 108 at the rear of the outer blades.

Pivoting of the outer blades is driven by an outer actuator 114 associated with each outer blade. The outer actuator 114 is a hydraulic linear actuator that extends from a first end pivotally coupled to the main blade to a second end pivotally coupled to the pivotal connection between the first and second links 110 and 112. The first end of the outer actuator 114 is pivotally coupled to the main blade at a location spaced longitudinally inward from the pivotal connection of the first links and the pivotal connection of the outer blade relative to the main blade. The outer actuator extends generally in the longitudinal direction of the main blade at the rear side thereof between opposing ends of the actuator. All of the pivotal connections of the linkage are about respective upright axes which are generally parallel to the pivotal axes between the blades which are in turn perpendicular to the common cutting plane of the blades.

As described above, extension and retraction of each outer actuator 114 will cause the first links 110 to be pivoted to extend rearward from an inward orientation to an outward orientation relative to the main blades which in turn causes the second links to displace the respective outer blade from the first position to the second position described above. Operating the outer actuators 114 independently of one another causes the outer blades to be deployed and undeployed independently of one another.

Figure 16:
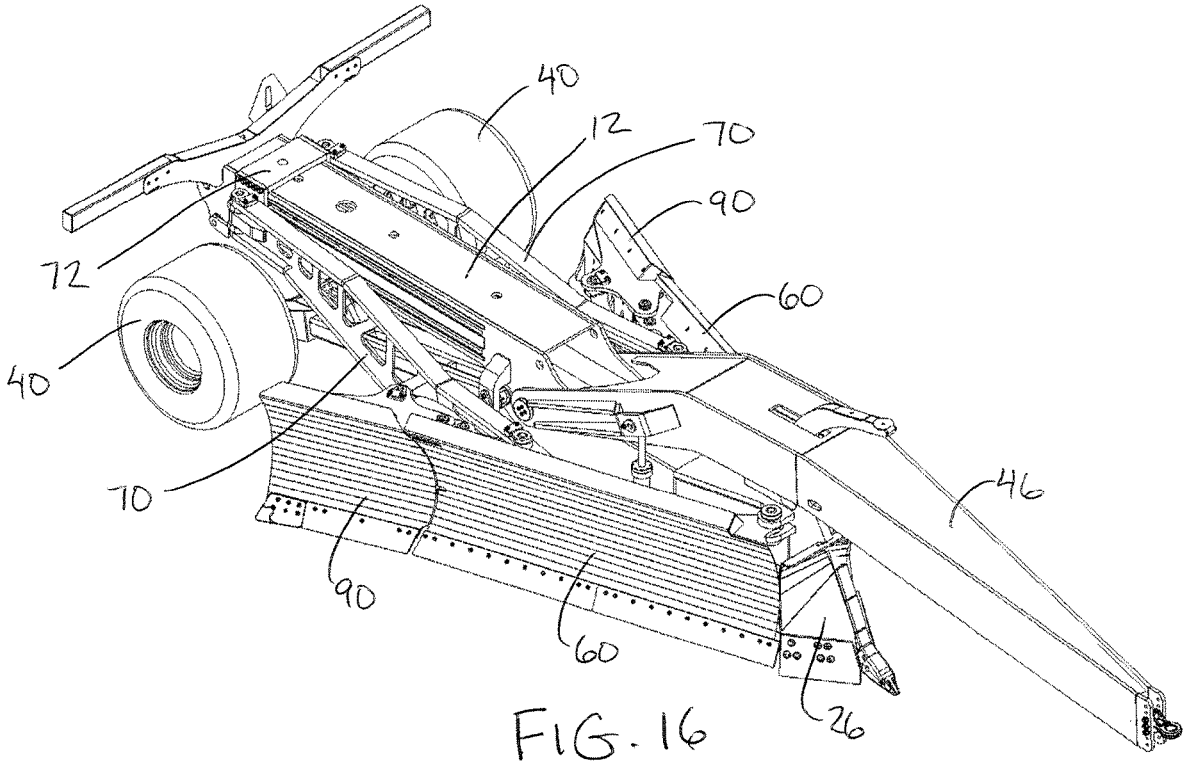
FIG. 16 is a perspective view of the earth moving implement in a transport mode for minimizing width for road transport.
Figure 17:
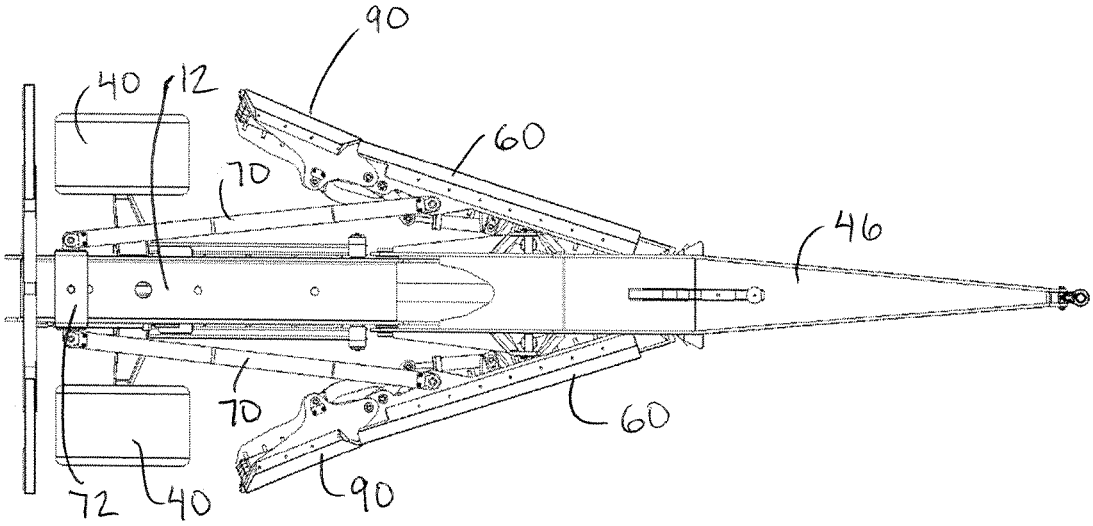
FIG. 17 is a top plan view of the earth moving implement in the transport mode of FIG. 16.

For transport of the implement on roadways, the blades can be positioned in the configuration shown in FIG. 16 in which the main blades assume the most narrow configuration oriented closest to the longitudinal axis while the outer blades are undeployed to extend continuously rearward from the main blades. This corresponds to a narrow road transport mode of operation of the implement.

To be better suited for transport on roadways, the main frame of the implement is further provided with a navigation bar 116 which extends in the direction of the lateral axis at the rear end of the main frame. The navigation bar 116 is a rigid frame member protruding laterally outwardly from both sides of the main frame to support suitable navigation lights 118 at the outer ends of the frame member. Suitable navigation lights include brake signalling lights and turn signalling lights and the like. The navigation bar extends the full width of the implement to define the overall width of the implement in the transport position of FIG. 16 by spanning wider than the overall width of the transport wheels. The blades of the implement in the transport position of FIG. 16 define an overall width in the lateral direction which is narrower than the width defined by the navigation bar 116.

In the transport position, the wheel actuators are typically extended in unison to raise the overall height of the rear end of the frame relative to the ground while operating the lift actuators between the main frame in the hitch arm to also raise the front end of the main frame relative to the hitch arm to ensure that the overall height of the frame supports the blades spaced above the ground.

When it is desired to cut ditches or trenches into the ground, the wheels can be raised in elevation relative to the main frame to lower the height of the rear end of the main frame relative to the ground, while also extending the lift actuators between the front end of the main frame in the hitch arm so as to lower the overall elevation of the blades to engage the blades with the ground. As the implement is towed across the ground with the blades lowered into engagement with the ground, the blades function to cut material from the ground and throw the material laterally outwardly at opposing sides of the implement for forming a ditch or trench.

Figure 13:
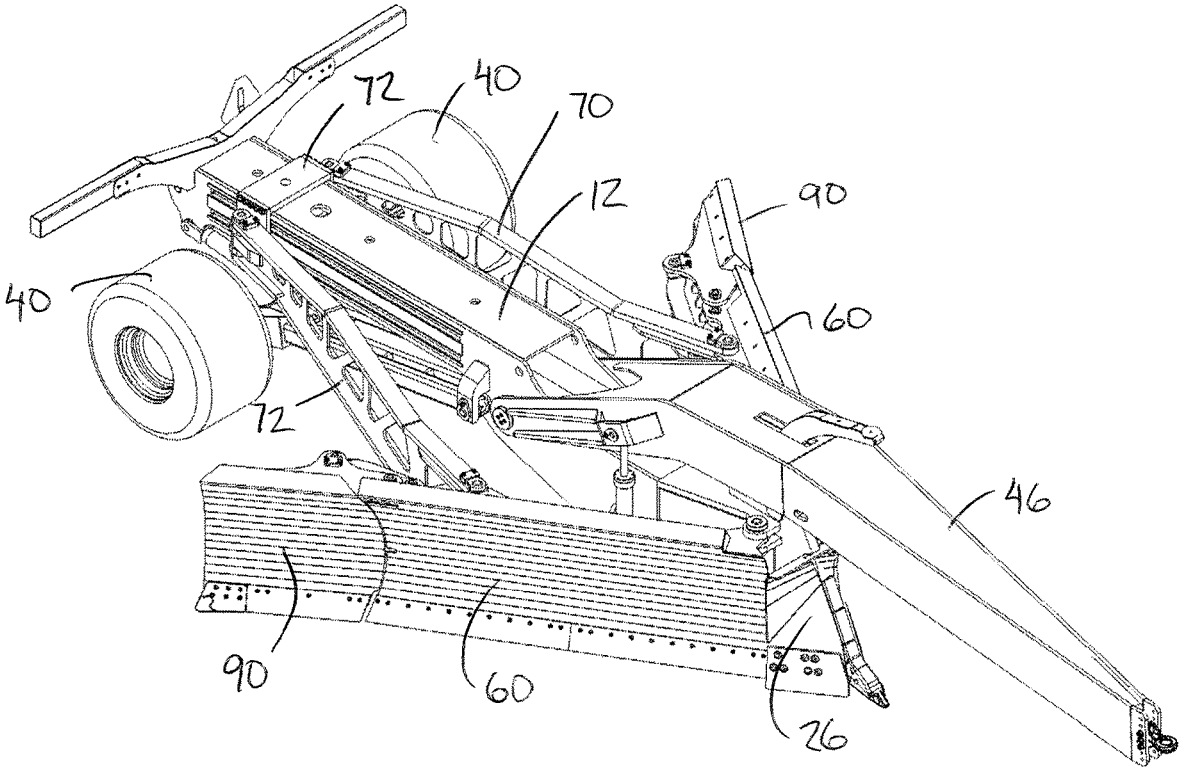
FIG. 13 is a perspective view of the earth moving implement in a high productive mode for forming a narrower trench than in the normal mode.

To form a narrow trench or rip, the main blades can be positioned according to the narrow trench mode of FIG. 13. In this instance, the main blades are positioned at a greater angle from the longitudinal axis than the transport position while remaining oriented closer in orientation to the longitudinal axis than the lateral axis. While maintaining a narrow overall configuration of the blades, lower draft forces are required to pull the implement through the ground such that trenches can be formed at high speeds with dirt being thrown laterally outwardly at opposing sides of the implement when the outer blades remain undeployed.

Figure 14:
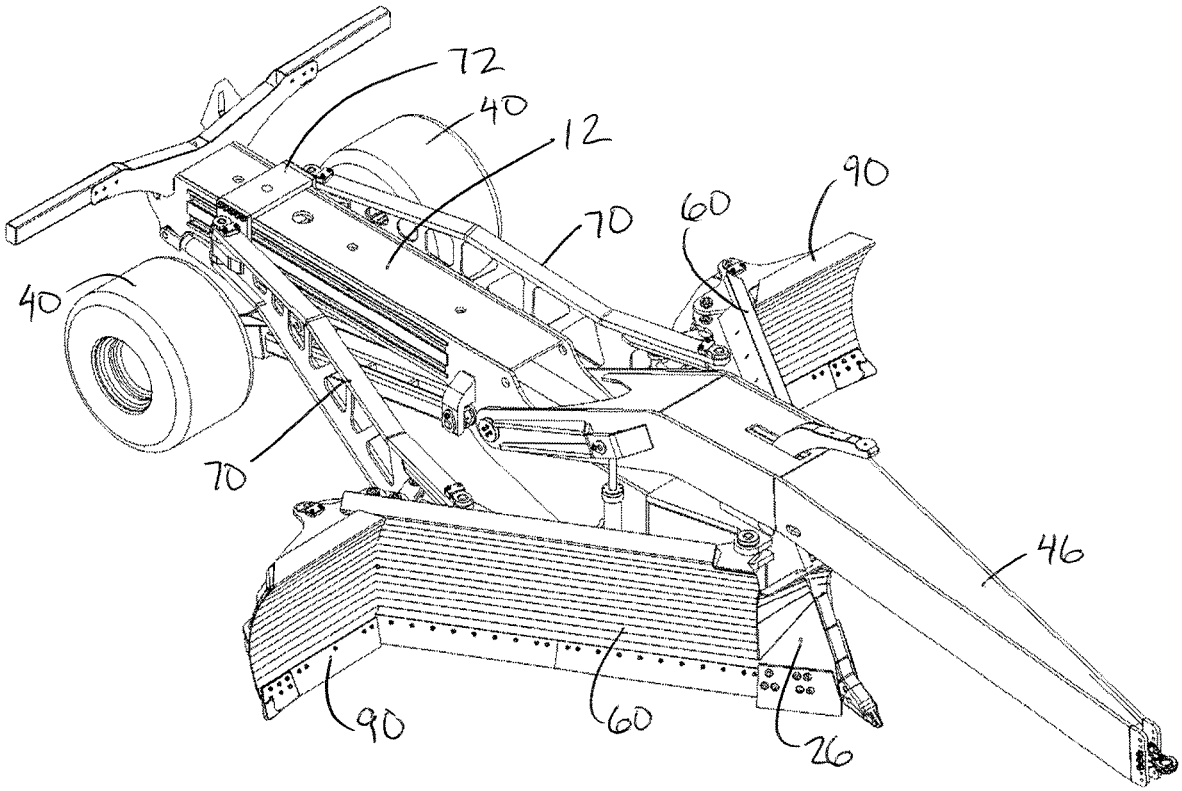
FIG. 14 is a perspective view of the earth moving implement in the high productive mode with outer blades enabled for carrying cut material from the ground while forming a narrower trench than the medium mode.
Figure 15:
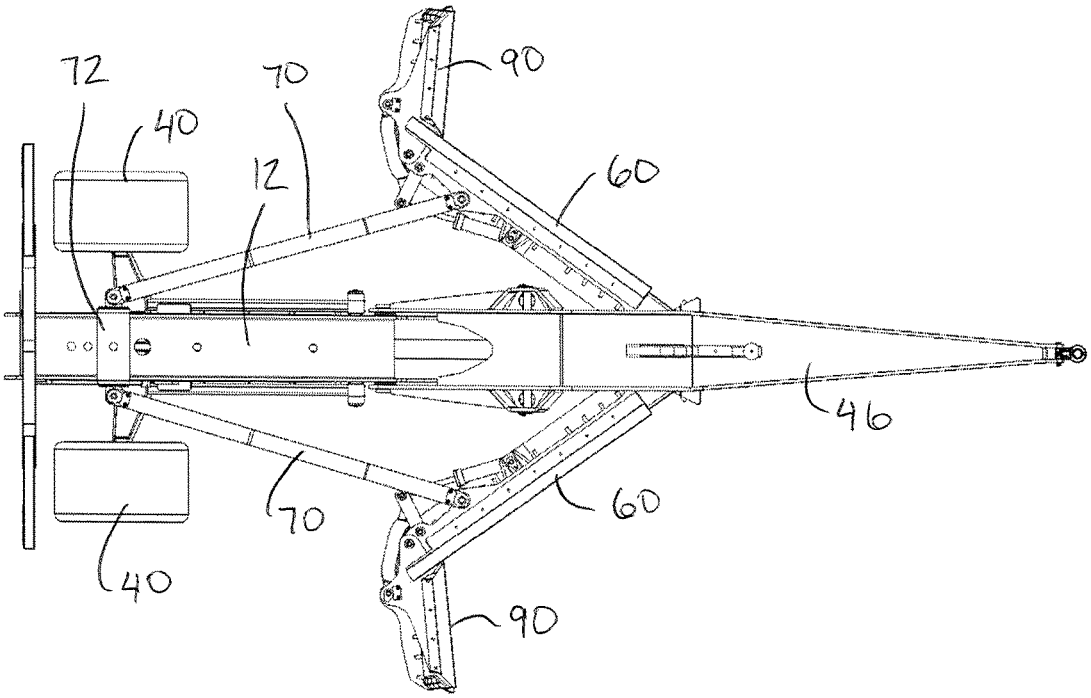
FIG. 15 is a top plan view of the earth moving implement in the high productive mode with enabled outer blades according to FIG. 14.

Alternatively, as shown in FIG. 14, the main blades can remain in the narrow trench mode of FIG. 13, however, one or both of the outer blades may be deployed. While the main blades remain in the narrow trench mode, the deployed outer blades are oriented approximately in the direction of the lateral axis so as to be nearly perpendicular to the forward working direction. When the outer blades are deployed in this manner, some of the material cut by the corresponding main blade is collected at the side of the ditch or trench being formed instead of being thrown laterally outwardly to the extent that material is thrown when forming a ditch according to the high productive trench mode of FIG. 13.

In a medium trench mode according to FIG. 1, with the outer blades remaining undeployed, the main blades and the outer blades extend at an intermediate angle for example an angle of near 45° to either the longitudinal or lateral axes. The overall cutting width of the blades in this instance is greater than the narrow trench mode of FIG. 13. This mode is suited for cutting medium-sized trenches; however, greater draft forces are required to pull the implement as compared to the narrow trench mode such that operation in the forward working direction is typically accomplished at a slower rate than the high productive mode of FIG. 13.

Figure 3:
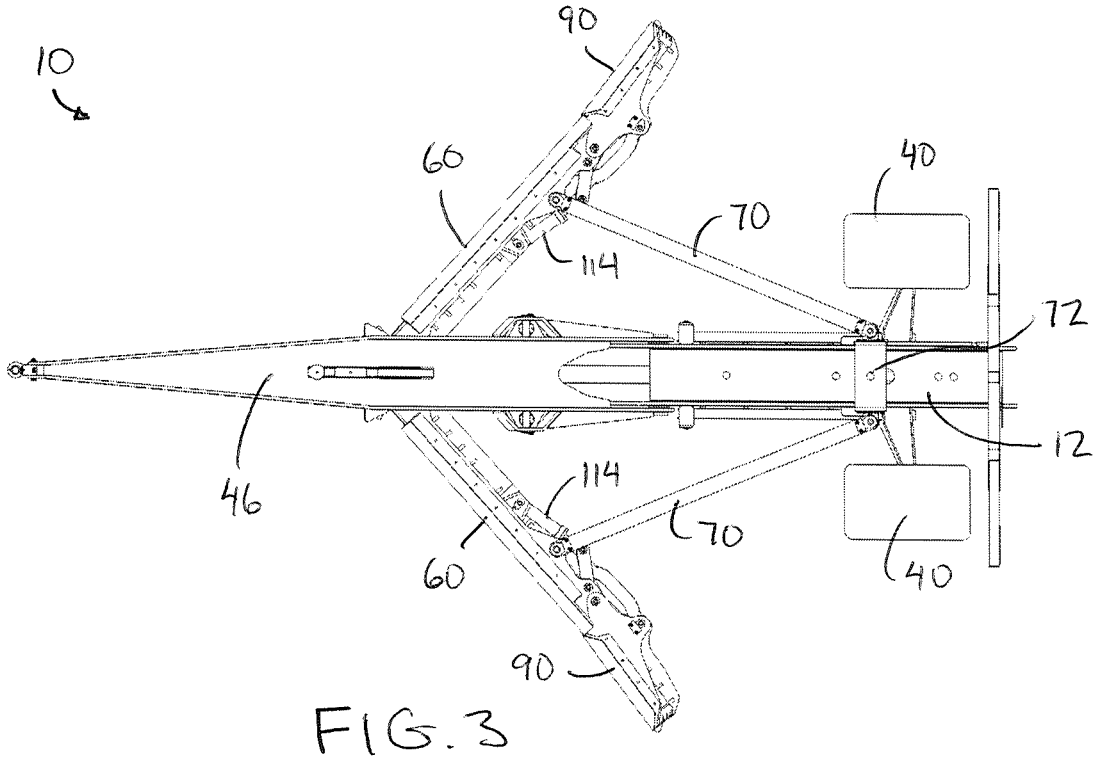
FIG. 3 is a top plan view of the earth moving implement according to FIG. 1.
Figure 4:
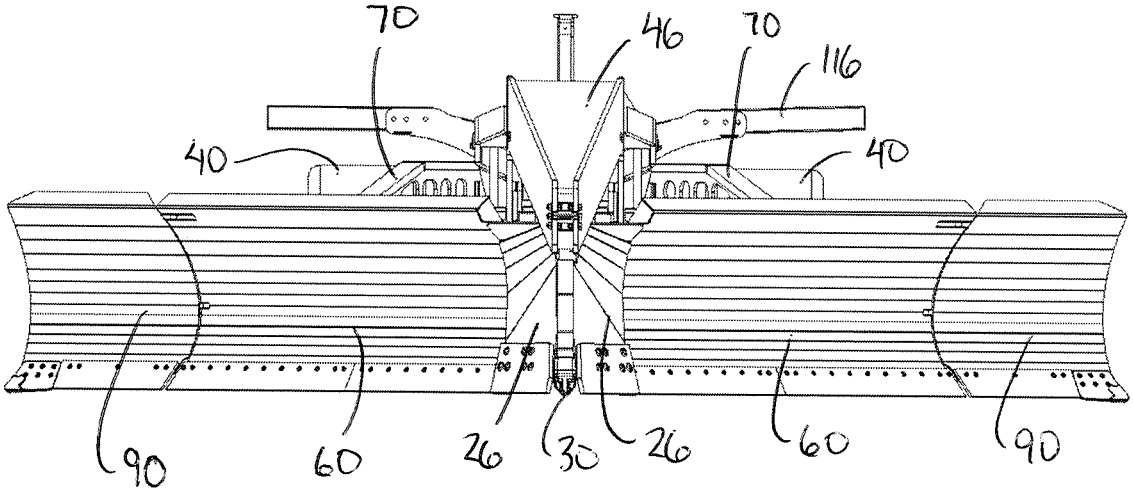
FIG. 4 is a front elevational view of the earth moving implement according to FIG. 1.
Figure 5:
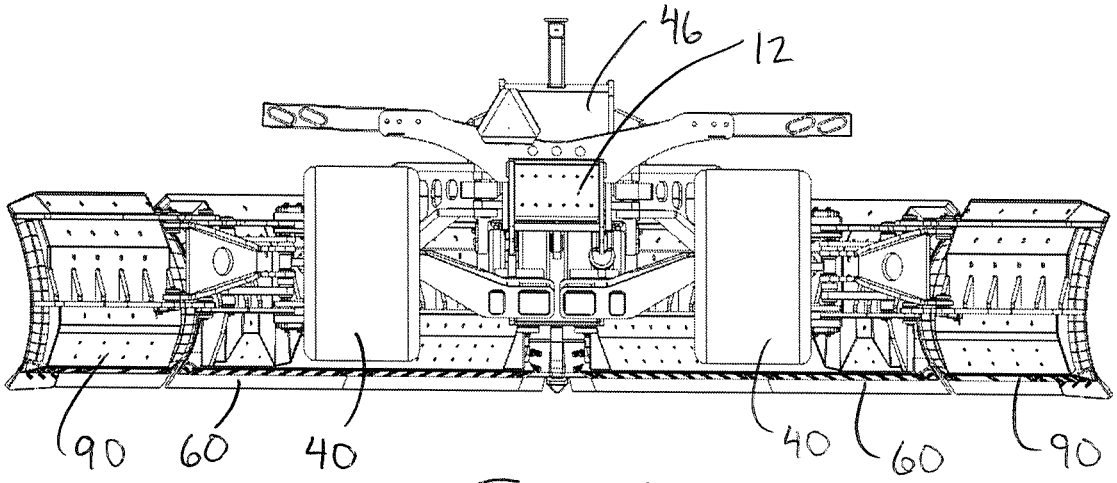
FIG. 5 is a rear elevational view of the earth moving implement according to FIG. 1.
Figure 6:
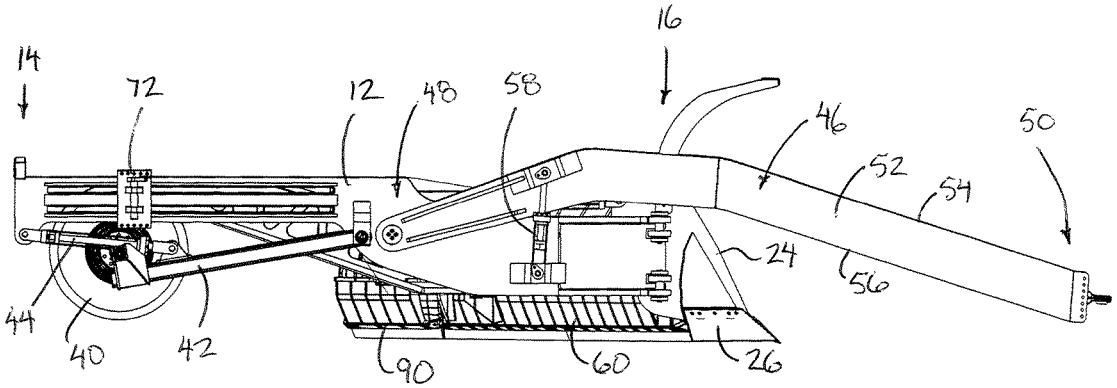
FIG. 6 is a side elevational view of the earth moving implement according to FIG. 1 in which some components have been removed for illustrative purposes.
Figure 7:
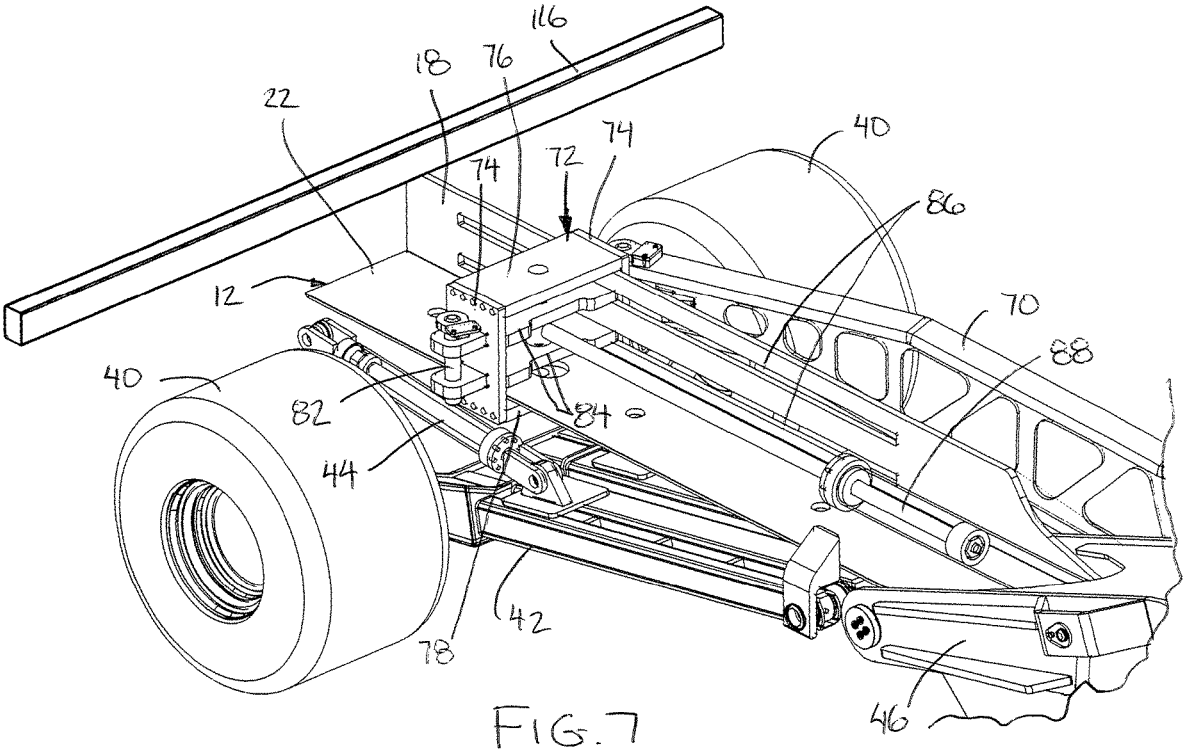
FIG. 7 is a perspective view of a portion of the earth moving implement according to FIG. 1 in which some components have been removed for illustrative purposes.
Figure 8:
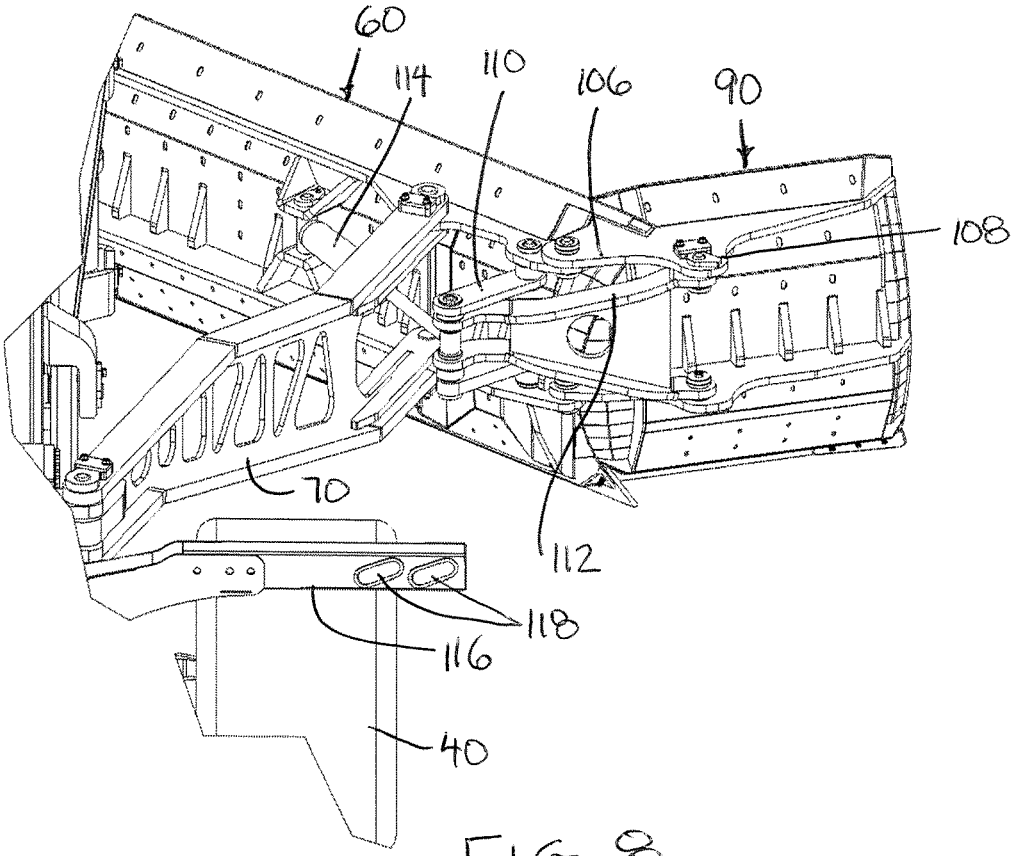
FIG. 8 is a perspective view of a linkage coupling one of the outer blades to the outer end of the respective main blade of the earth moving implement.
Figure 12:
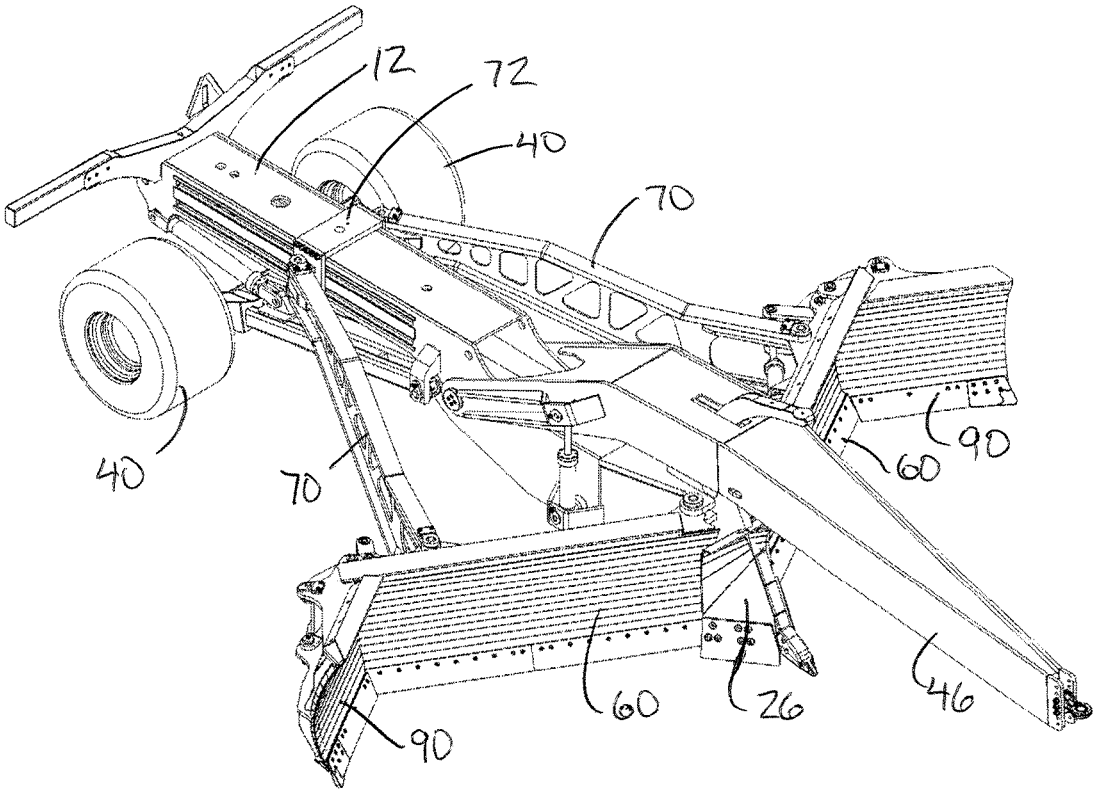
FIG. 12 is a perspective view of the earth moving implement in a normal mode with outer blades enabled for carrying cut material from the ground while forming a medium width trench.

With the main blades remaining in the medium trench mode according to FIG. 1, one or both of the outer blades can be deployed into the second position by pivoting the outer blade(s) from the undeployed position extending outward and rearward as shown in FIG. 3 to the deployed position extending outward and forward as shown in FIG. 12. In this instance, the main blades remain at a rearward slope from the inner ends to the outer ends thereof; however, the outer blades are oriented transversely at a forward slope from the inner ends to the outer ends thereof. In this instance, the main blades maintain a medium cutting width in the lateral direction, however cut material from the ground by the blades tends to be carried forward by the blades as the implement is towed in the forward working direction.

The blades can be yet further positioned in a grader mode or position by pivoting the main blades to their forward orientation oriented primarily in the lateral direction at an inclination of less than 10° from the lateral axis. When the outer blades remain undeployed according to FIG. 9, the blades define the maximum overall cutting width in the lateral direction. The blades in this instance function as a grader for leveling ground and shaping ground in the usual manner of a grader blade.

While the main blades remain oriented as shown in FIG. 9, one or both of the outer blades may be deployed in the manner of FIG. 10 to assist in carrying and spreading material which has been cut from the ground by the blades. When the outer blades are deployed in the grader position of the main blades, the outer blades extend forwardly from the main blades at an angular orientation which is closer to the longitudinal axis than the lateral axis such that the overall configuration of blades function as a box blade for a grader.

As the main blades are pivoted through a range of angular orientations relative to the main frame by sliding of the carriage member longitudinally along the main frame, the primary folder actuator 88 may be hydraulically locked at any of the orientations of the main blade noted above to fix the main blades at a selected angular orientation relative to the main frame. In addition, or instead of a locking the hydraulics, a suitable locking member (not shown) may extend through cooperating apertures 120 in the top of the carriage member and the top of the main frame respectively. The locking member may comprise any suitable pin type member which is releasably inserted through the aperture in the carriage member and a corresponding aperture in the main frame aligned with the carriage member aperture to prevent further longitudinal sliding of the carriage member relative to the main frame, which in turn, fixes the main blades relative to the main frame at the selected orientation.

Since various modifications can be made in my invention as herein above described, and many apparently widely different embodiments of same made, it is intended that all matter contained in the accompanying specification shall be interpreted as illustrative only and not in a limiting sense.

The invention claimed is:

1. An earth moving implement for forming a ditch when towed across ground in a forward working direction by a towing vehicle, the earth moving implement comprising:

a main frame defining a longitudinal axis extending in the forward working direction from a rear end to a front end of the frame;

a tow arm connected to the frame and arranged for connection to the towing vehicle;

two wheels rotatably supported on the main frame so as to be arranged to support the frame for rolling movement along the ground, the two wheels being spaced apart in opposing lateral directions from the longitudinal axis of the main frame along a lateral axis oriented perpendicularly to the longitudinal axis;

a blade assembly supported on the main frame comprising a plurality of earth moving blades arranged to be configured to extend rearwardly in said opposing lateral directions from a blade apex of the blade assembly such that the earth moving blades diverge rearwardly from the blade apex;

the earth moving blades including two main blades supported on the main frame, each main blade extending in a respective one of the opposing lateral directions from an inner end of the main blade pivotally coupled in proximity to the blade apex of the blade assembly to an outer end of the main blade such that the main blade is pivotal relative to the main frame about a respective upright main blade axis; and the earth moving blades including two outer blades operatively connected to the two main blades respectively, each outer blade extending outwardly from an inner end of the outer blade pivotal coupled in proximity to the outer end of the respective main blade to an outer end of the outer blade such that the outer blade is pivotal relative to the respective main blade about a respective upright outer blade axis;

each of the main blades and the outer blades having a bottom cutting edge arranged for cutting into the ground;

whereby pivotal movement of the outer blades relative to the main blades and pivotal movement of the main blades relative to the main frame acts to vary an overall cutting width of the bottom cutting edges of the earth moving blades in a direction of the lateral axis;

wherein the earth moving blades are configured such that the bottom cutting edges of the outer blades remain in a common plane with the bottom cutting edges of the main blades (i) as the main blades are displaced relative to the main frame about the main blade axes and (ii) as the outer blades are displaced relative to the main blades about the outer blade axes; and wherein each of the main blade axes is perpendicular to said common plane of the bottom cutting edges and each of the outer blade axes is perpendicular to said common plane of the bottom cutting edges throughout pivotal movement of the outer blades relative to the main blades and pivotal movement of the main blades relative to the main frame.

2. The earth moving implement according to claim 1 wherein the bottom cutting edges of the main blades occupy a majority of the overall cutting width of the earth moving blades.

3. The earth moving implement according to claim 1 wherein the main blades are pivotal from a forward position oriented nearer to the lateral axis than the longitudinal axis to a rear position oriented nearer to the longitudinal axis than the lateral axis.

4. The earth moving implement according to claim 3 wherein the main blades are oriented at less than 45 degrees from the longitudinal axis in the rear position.

5. The earth moving implement according to claim 4 wherein the outer blades are pivotal relative to the main blades so as to be positionable at an angle of less than 10 degrees from the lateral axis when the main blades are oriented at a prescribed angle from the longitudinal axis that is between 25 and 45 degrees.

6. The earth moving implement according to claim 1 wherein the two wheels are adjustable in height relative to the main frame independently from one another so as to be arranged to vary an angular orientation of said common plane of the bottom cutting edges of the main blades together with the main frame relative to the ground about the longitudinal axis.

7. The earth moving implement according to claim 6 further comprising two trailing arms pivotally coupled to the main frame are respective front ends of the trailing arms and respectively supporting the two wheels rotatably thereon at respective rear ends of the trailing arms, the trailing arms being independently pivotal relative to the main frame so as to vary the heights of the respective wheels relative to the main frame.

8. The earth moving implement according to claim 1 wherein the earth moving blades of the blade assembly further comprise two lead blades supported in fixed relation on the main frame so as to meet one another at the blade apex of the blade assembly and so as to extend rearwardly in said opposing lateral directions from the blade apex.

9. An earth moving implement for forming a ditch when towed across ground in a forward working direction by a towing vehicle, the earth moving implement comprising:

a main frame defining a longitudinal axis extending in the forward working direction from a rear end to a front end of the frame;

a tow arm connected to the frame and arranged for connection to the towing vehicle;

two wheels rotatably supported on the main frame so as to be arranged to support the frame for rolling movement along the ground, the two wheels being spaced apart in opposing lateral directions from the longitudinal axis of the main frame along a lateral axis oriented perpendicularly to the longitudinal axis;

a blade assembly supported on the main frame comprising a plurality of earth moving blades arranged to be configured to extend rearwardly in said opposing lateral directions from a blade apex of the blade assembly such that the earth moving blades diverge rearwardly from the blade apex;

the earth moving blades including two main blades supported on the main frame, each main blade extending in a respective one of the opposing lateral directions from an inner end of the main blade pivotally coupled in proximity to the blade apex of the blade assembly to an outer end of the main blade such that the main blade is pivotal relative to the main frame about a respective upright axis; and the earth moving blades including two outer blades operatively connected to the two main blades respectively, each outer blade extending outwardly from an inner end of the outer blade pivotal coupled in proximity to the outer end of the respective main blade to an outer end of the outer blade such that the outer blade is pivotal relative to the respective main blade about a respective upright axis;

each of the main blades and the outer blades having a bottom cutting edge arranged for cutting into the ground;

whereby pivotal movement of the outer blades relative to the main blades and pivotal movement of the main blades relative to the main frame acts to vary an overall cutting width of the bottom cutting edges of the earth moving blades in a direction of the lateral axis;

wherein the main blades are pivotal from a forward position oriented nearer to the lateral axis than the longitudinal axis to a rear position oriented nearer to the longitudinal axis than the lateral axis; and wherein the main blades are oriented at less than 10 degrees from the lateral axis in the forward position.

10. The earth moving implement according to claim 9 wherein at least one of the main blades is pivotal beyond the forward position to a forwardmost position in which the main blade extends laterally outwardly at a forward slope.

11. The earth moving implement according to claim 9 wherein the outer blades are pivotal relative to the main blades so as to be positionable at an angle of less than 45 degrees from the longitudinal axis when the main blades are in the forward position.

12. The earth moving implement according to claim 9 further comprising a brace arm connecting each main blade to the main frame such that the brace arms extend rearwardly and inwardly towards one another, each brace arm being oriented at an angle from the longitudinal axis of less than 45 degrees throughout an overall range of pivotal movement of the main blades relative to the main frame.

13. The earth moving implement according to claim 12 wherein the brace arms are oriented at less than 45 degrees from the longitudinal axis throughout said overall range of pivotal movement of the main blades relative to the main frame.

14. An earth moving implement for forming a ditch when towed across ground in a forward working direction by a towing vehicle, the earth moving implement comprising:

a main frame defining a longitudinal axis extending in the forward working direction from a rear end to a front end of the frame;

a tow arm connected to the frame and arranged for connection to the towing vehicle;

two wheels rotatably supported on the main frame so as to be arranged to support the frame for rolling movement along the ground, the two wheels being spaced apart in opposing lateral directions from the longitudinal axis of the main frame along a lateral axis oriented perpendicularly to the longitudinal axis;

a blade assembly supported on the main frame comprising a plurality of earth moving blades arranged to be configured to extend rearwardly in said opposing lateral directions from a blade apex of the blade assembly such that the earth moving blades diverge rearwardly from the blade apex;

the earth moving blades including two main blades supported on the main frame, each main blade extending in a respective one of the opposing lateral directions from an inner end of the main blade pivotally coupled in proximity to the blade apex of the blade assembly to an outer end of the main blade such that the main blade is pivotal relative to the main frame about a respective upright axis;

the earth moving blades including two outer blades operatively connected to the two main blades respectively, each outer blade extending outwardly from an inner end of the outer blade pivotal coupled in proximity to the outer end of the respective main blade to an outer end of the outer blade such that the outer blade is pivotal relative to the respective main blade about a respective upright axis;

each of the main blades and the outer blades having a bottom cutting edge arranged for cutting into the ground in which pivotal movement of the outer blades relative to the main blades and pivotal movement of the main blades relative to the main frame acts to vary an overall cutting width of the bottom cutting edges of the earth moving blades in a direction of the lateral axis;

a carriage member slidably mounted on the main frame along the longitudinal axis of the main frame; and two brace members connected between the carriage member and the main blades respectively;

wherein each brace member is pivotally mounted on the respective main blade at an outer end of the brace member;

wherein each brace member is pivotally mounted on the carriage member at an inner end of the brace member; and wherein the brace members extend rearwardly and inwardly towards one another from the outer ends of the brace members mounted on the main blades to the inner ends of the brace members mounted on the carriage member throughout an overall range of pivotal movement of the main blades relative to the main frame.

15. The earth moving implement according to claim 14 wherein the carriage member is arranged to be fixed relative to the main frame by a locking member at any selected one of a plurality of designated mounting locations between a forward position and a rear position of the main blades relative to the main frame.

16. An earth moving implement for forming a ditch when towed across ground in a forward working direction by a towing vehicle, the earth moving implement comprising:

a main frame defining a longitudinal axis extending in the forward working direction from a rear end to a front end of the frame;

a tow arm connected to the frame and arranged for connection to the towing vehicle;

two wheels rotatably supported on the main frame so as to be arranged to support the frame for rolling movement along the ground, the two wheels being spaced apart in opposing lateral directions from the longitudinal axis of the main frame along a lateral axis oriented perpendicularly to the longitudinal axis;

a blade assembly supported on the main frame comprising a plurality of earth moving blades arranged to be configured to extend rearwardly in said opposing lateral directions from a blade apex of the blade assembly such that the earth moving blades diverge rearwardly from the blade apex;

the earth moving blades including two main blades supported on the main frame, each main blade extending in a respective one of the opposing lateral directions from an inner end of the main blade pivotally coupled in proximity to the blade apex of the blade assembly to an outer end of the main blade such that the main blade is pivotal relative to the main frame about a respective upright axis; and the earth moving blades including two outer blades operatively connected to the two main blades respectively, each outer blade extending outwardly from an inner end of the outer blade pivotal coupled in proximity to the outer end of the respective main blade to an outer end of the outer blade such that the outer blade is pivotal relative to the respective main blade about a respective upright axis;

each of the main blades and the outer blades having a bottom cutting edge arranged for cutting into the ground;

whereby pivotal movement of the outer blades relative to the main blades and pivotal movement of the main blades relative to the main frame acts to vary an overall cutting width of the bottom cutting edges of the earth moving blades in a direction of the lateral axis;

wherein each outer blade is pivotal relative to the respective main blade between a first position in which the outer blade extends outward from the outer end of the main blade at an angle of less than 5 degrees from the main blade, and a second position in which the inner end of the outer blade abuts a front face of the main blade at a location spaced inwardly from the outer end of the main blade such that an interior angle between a front face of the outer blade and the front face of the main blade is an obtuse angle that is less than 135 degrees.

17. The earth moving implement according to claim 16 wherein the front face of each main blade is concave from the bottom cutting edge to an opposing top edge and wherein an inner edge at the inner end of each outer blade is convex in shape so as to mate with the concave front face of the respective main blade in the second position of the outer blade.

18. An earth moving implement for forming a ditch when towed across ground in a forward working direction by a towing vehicle, the earth moving implement comprising:

a main frame defining a longitudinal axis extending in the forward working direction from a rear end to a front end of the frame;

a tow arm connected to the frame and arranged for connection to the towing vehicle;

two wheels rotatably supported on the main frame so as to be arranged to support the frame for rolling movement along the ground, the two wheels being spaced apart in opposing lateral directions from the longitudinal axis of the main frame along a lateral axis oriented perpendicularly to the longitudinal axis;

a blade assembly supported on the main frame comprising a plurality of earth moving blades arranged to be configured to extend rearwardly in said opposing lateral directions from a blade apex of the blade assembly such that the earth moving blades diverge rearwardly from the blade apex;

the earth moving blades including two main blades supported on the main frame, each main blade extending in a respective one of the opposing lateral directions from an inner end of the main blade pivotally coupled in proximity to the blade apex of the blade assembly to an outer end of the main blade such that the main blade is pivotal relative to the main frame about a respective upright axis; and the earth moving blades including two outer blades operatively connected to the two main blades respectively, each outer blade extending outwardly from an inner end of the outer blade pivotal coupled in proximity to the outer end of the respective main blade to an outer end of the outer blade such that the outer blade is pivotal relative to the respective main blade about a respective upright axis;

each of the main blades and the outer blades having a bottom cutting edge arranged for cutting into the ground;

wherein pivotal movement of the outer blades relative to the main blades and pivotal movement of the main blades relative to the main frame acts to vary an overall cutting width of the bottom cutting edges of the earth moving blades in a direction of the lateral axis;

wherein the bottom cutting edges of the main blades occupy a majority of the overall cutting width of the earth moving blades;

wherein the main blades are pivotal into a working position oriented to extend rearwardly and outwardly from one another; and wherein, in the working position of the main blades, each outer blade is pivotal relative to the respective main blade between an undeployed position in which the outer blade extends outwardly and rearwardly from the respective main blade and a deployed position in which the outer blade extends outwardly and forwardly from the respective main blade.

19. The earth moving implement according to claim 18 wherein the outer blades are pivotal relative to the main blades so as to be positionable at an angle of less than 45 degrees from the longitudinal axis when the main blades are in the working position.

* * * * *